US005486384A

United States Patent [19]

Bastian et al.

[11] Patent Number: 5,486,384

[45] Date of Patent: Jan. 23, 1996

[54] PROCESS FOR PRODUCING MULTI-LAYER COATINGS BY THE USE OF CLEAR LACQUERS WHICH ARE CAPABLE OF POLYMERIZATION IN RADICALIC AND/OR CATIONIC MANNER

[75] Inventors: Udo Bastian, Ratingen; Manfred Stein, Hürth, both of Germany

[73] Assignee: Herberts GmbH, Wuppertal, Germany

[21] Appl. No.: 148,025

[22] Filed: Nov. 5, 1993

Related U.S. Application Data

[63] Continuation of Ser. No. 953,412, Sep. 29, 1992, abandoned.

[30] Foreign Application Priority Data

Oct. 8, 1991 [DE] Germany ..... 41 33 290.3

[51] Int. Cl.[6] ..... B05D 3/02

[52] U.S. Cl. ..... 427/493; 427/385.5; 427/388.1; 427/409; 427/421; 427/498; 427/500; 427/512; 427/514; 427/551; 427/558; 427/559; 427/581; 427/595

[58] Field of Search ..... 427/493, 498, 427/500, 512, 514, 551, 558, 559, 581, 595, 385.5, 388.1, 409, 421

[56] References Cited

FOREIGN PATENT DOCUMENTS

| | | |
|---|---|---|
| 0118705 | 9/1984 | European Pat. Off. . |
| 0038127 | 10/1984 | European Pat. Off. . |
| 0184761 | 6/1986 | European Pat. Off. . |
| 0247563 | 12/1987 | European Pat. Off. . |
| 0321607 | 6/1989 | European Pat. Off. . |
| 0402772 | 12/1990 | European Pat. Off. . |
| 3322037 | 12/1984 | Germany . |
| 3600425 | 7/1986 | Germany . |
| 3615790 | 11/1986 | Germany . |
| 2226566 | 7/1990 | United Kingdom . |

OTHER PUBLICATIONS

English language Abstract of Japanese patent publication No. JP–A–6213 2570 dated Jun. 15, 1987.

*Primary Examiner*—Bernard Pianalto
*Attorney, Agent, or Firm*—Keck, Mahin & Cate

[57] ABSTRACT

Process for producing a multi-layer lacquer coating by the application of a coat of clear lacquer including coating agents which are curable exclusively by polymerization in radicalic and/or cationic manner to a dried or crosslinked colored and/or effect-producing basecoat film process is performed in light having a wavelength of over 550 nm or subject to the exclusion of light. The application step is followed by initiation or implementation of curing of the clear-lacquer film by high-energy radiation. The process is particularly suitable for producing multi-layer lacquer coatings in the automobile industry.

14 Claims, No Drawings

PROCESS FOR PRODUCING MULTI-LAYER COATINGS BY THE USE OF CLEAR LACQUERS WHICH ARE CAPABLE OF POLYMERIZATION IN RADICALIC AND/OR CATIONIC MANNER

This is a continuation of application Ser. No. 07/953,412 filed on Sep. 29, 1992, abandoned, the text of which is hereby incorporated by reference.

BACKGROUND OF THE INVENTION

1. Field of the Invention

The invention relates to a process for producing a multi-layer lacquer coating with a mechanically stable quick-drying clear-lacquer coating based on systems curable by radiation.

2. Description of Related Art

Coatings as applied in the series production of automobiles nowadays mostly consist of a surface lacquer of basecoat and clear lacquer which is applied to bodywork that has been electrophoretically primed and coated with filler. In this process basecoat and clear lacquer are preferably applied wet-on-wet, i.e. after a flash-off period optionally subject to heating. After subsequent application of a clear lacquer the basecoat is stoved together with this lacquer, as described for example in EP-A-38 127 and EP-A-402 772. In this connection suitable clear lacquers are described, for example, in EP-A-38 127 and EP-A-184 761. The stoving process in industrial production lacquering requires long drying phases, and naturally a certain time passes before the lacquer is no longer tacky, so that special measures have to be taken in order to avoid incorporating dust in the surface.

Both in the case of the use of one-component (1C) and also of two-component (2C) clear lacquers the lacquering process is associated with emissions of environmentally harmful solvents or dissociation products of the crosslinking reaction. In the case for example of isocyanate-crosslinking 2C clear lacquers, e.g. according to DE-OS 33 22 037 or DE-PS 36 00 425, recycling of overspray is by its nature not possible.

In JP-A-6213 2570 clear UV lacquers are described which serve to protect electrical instruments used in domestic appliances and in the automobile industry. They are applied in a thin film; multiple precoating does not take place.

In EP-A-0 118 705 and GB-A-2 226 566 UV-curable layers are described for protecting automobile underbodies from the impact of stones. The layers are applied with a thickness of up to 1500 μm. They are formulated so as to be soft and elastic and are not capable of being ground.

In EP-A-0 247 563 coatings are described which by way of surface lacquer have a coating which in addition to an isocyanate-hydroxyl-group crosslinking reaction is also subjected to crosslinking by UV radiation. The overspray accruing during application of the coating agent can in view of the chemical reaction no longer be subjected to recycling.

SUMMARY OF THE INVENTION

The object of the invention is to make available a lacquering process for a multi-layer lacquer coating, in particular for the automobile industry, in which a clear lacquer enabling fast crosslinking is used as surface-lacquer coating, in which process the overspray following application can be recycled, and in which a shiny or matt, hard and clear surface lacquer is produced by way of substrate coating.

It has been shown that this aim can be achieved by a process for producing a multi-layer lacquer coating in which a liquid clear lacquer which can be crosslinked exclusively by radicalic and/or cationic polymerization is applied to a previously dried basecoat layer. Application of the clear lacquer is effected while daylight is screened off, optionally during illumination with visible light having a wavelength of over 550 nm. The overspray accruing during application of the clear lacquer is collected and can optionally be re-used for spraying after recycling. Curing of the clear-lacquer layer is subsequently effected by irradiation with high-energy radiation or is initiated by irradiation with high-energy radiation.

An advantage of the process according to the invention consists in the fact that substrates which are sensitive to temperature can also be provided with a durable layer of surface lacquer. In addition, as a result of short reaction and drying times, pollution of the freshly lacquered surface can be avoided. The surfaces obtained in this way have good optical characteristics and a high degree of resistance to scratching.

DETAILED DESCRIPTION OF THE PREFERRED EMBODIMENT

The lacquer systems which can be used according to the invention all make use of coating agents which are curable by radiation and which crosslink exclusively as a result of radicalic or cationic polymerisation or combinations thereof. Aqueous systems rich in solids and occurring as emulsions constitute a preferred embodiment of the invention. But coating agents containing solvents can also be used. Particularly preferred are 100% lacquer systems which can be applied without solvent and without water. The clear lacquers curable by radiation can be formulated as unpigmented or transparently pigmented surface lacquers, optionally coloured with soluble dyestuffs.

The clear-lacquer coatings can be applied to conventional basecoats. These may contain solvents or be of an aqueous or powdery type. The basecoats contain conventional physically drying and/or chemically crosslinking binding agents, inorganic and/or organic colouring pigments and/or pigments producing special effects, such as metallic pigments or those giving a pearly-lustre, as well as other auxiliary substances which are customary in lacquering, such as catalysts, levelling agents or anti-cratering agents. These basecoats are applied to conventional substrates either direct or on pre-coated substrates. Prior to application of the basecoat the substrates can, for example, be provided with conventional primer, filler and intermediate layers such as are customary for, e.g., multi-layer lacquer coatings in the automobile industry. Metal or plastic parts are suitable as substrates.

Prior to coating with radiation-curable lacquers the layers of primer are dried or stoved under such conditions as to ensure that they only contain small amounts of volatile substances. In particular, at the time of the radiation-induced crosslinking reaction of the applied layer of clear-lacquer coating, substantial amounts of volatile components should no longer be present in the basecoat layer. Such components can impair gloss and adhesion in the clear-lacquer film. Drying of the basecoat layer can be effected at room temperature or at temperatures up to 150° C. This does not exclude the possibility of a chemical crosslinking reaction.

In the particularly preferred case of solvent-free radiation-curable clear-lacquer systems, the process according to the invention enables a particularly good metal effect to be achieved on metallic basecoats by way of basecoat layer.

After application and drying of the basecoat the workpiece is provided with the radiation-curable surface lacquer. Until the workpiece is discharged from the coating unit the coating process is carried out subject to illumination with visible light having a wavelength of over 550 nm or subject to the exclusion of light. To this end necessary measures for screening off other light sources are optionally employed, e.g. light traps at the entrances and exits of the lacquering plant, filters in front of light sources or measures for preventing reflection. The only light sources used have an emission spectrum starting at above 550 nm. Such sources are, e.g., lamps provided with UV filters or yellow filters. Illumination optionally also can be effected from outside by the use of windows. During stages of the process which run automatically and need no optical control it is of course possible to proceed subject to the exclusion of light, so that the above-stated light sources only have to be switched on if a fault occurs. In the case of pure electron-ray curing with suitable lacquer systems work can also proceed under normal lighting conditions.

Application of the radiation-curable lacquer can be carried out by all conventional spray-application methods, such as, e.g., compressed-air spraying, airless spraying, high-speed rotation, electrostatic spray application (ESTA), optionally coupled with hot-spray application such as hot-air spraying, at temperatures not exceeding 70°–80° C. In this manner suitable application viscosities are achieved and no change occurs in either the lacquer material or the overspray to be recycled during the short time that the thermal treatment is applied. In this way hot spraying can be organized in such a way that the lacquer material is only heated for a short time in the spray jet or a short distance upstream of it.

The spraying booth may optionally be a circulation-type booth of adjustable temperature, operated with an absorption medium suitable for the overspray, e.g. the lacquer material. The spraying booth consists of materials which preclude the possibility of contamination of the material to be recycled and which are not affected by the circulating medium. Examples are high-grade steel or suitable plastics.

By avoiding light with a wavelength below 550 nm the lacquer material used and the overspray are not affected. This enables direct reprocessing. The recycling unit essentially comprises a filtration unit and a mixing device which maintains an adjustable ratio of fresh lacquer material to be reprocessed and optionally circulates lacquer material. In addition, storage containers and pumps as well as control devices are present. When non-100% lacquer material is used a mixing device is necessary for maintaining a constant level of volatile components such as organic solvent components or water.

Application is performed in such a manner that dry layer thicknesses of preferably 10–80 μm, and in particular 30–60 μm, are achieved. Application of the clear lacquer can optionally be effected in several layers.

After application of the clear-lacquer coating agent the coated substrate is optionally subjected after a rest period to the crosslinking process. The rest period serves for example to enable levelling, degassing of the lacquer film or evaporation of volatile components such as solvents, water or $CO_2$ if the lacquer material has been applied using supercritical carbon dioxide as solvent, as described for example in EP-A-321 607. It can optionally also be supported by increased temperatures of up to 80° C., and preferably up to 60° C.

The actual radiation-curing process can be carried out either by UV radiation or electron-ray radiation or with actinic radiation emitted from other radiation sources. In the case of electron-ray radiation it is preferable to work in an atmosphere of inert gas. This can be achieved for example by supplying $CO_2$, $N_2$ or a mixture of both directly to the surface of the substrate.

Use may also be made of an atmosphere of inert gas in the case of UV curing. If a protective gas is not used, ozone may be generated. This can, for example, be extracted by suction.

Preferred radiation sources are UV emitters or electron-ray sources. UV radiation sources having emissions in the wavelength range 180–420 nm, and preferably 200–400 nm, are, for example:

optionally doped high-pressure, medium-pressure and low-pressure mercury emitters, gas discharge tubes such as low-pressure xenon lamps, pulsed and unpulsed UV lasers, and UV spot-type emitters such as UV-emitting diodes. Particularly suitable radiation sources emitting in the longwave UV spectrum are so-called black-light tubes. Measures can optionally be taken to counter the heat of the radiation source, e.g. by cooling with water or air.

Cathode-ray sources include, spot-type emitters working according to the electron-ray principle (i.e., made by Polymerphysik, Tübingen) or linear cathodes which work according to the Electrocurtain® principle (i.e., made by Energie Science Inc). They have a radiation output of 100 keV to 1 MeV. Combinations of these radiation sources are also possible.

Both the electron sources and the UV radiation sources can also be designed to work discontinuously. Particularly suitable then are laser light sources or electron sources. Another possibility with regard to provision of UV sources capable of being rapidly switched on and off (pulsed operation) includes interposing, e.g., moveable shutters.

By way of auxiliary units, conventional light-control systems may be used which are customary in the sphere of optics technology, such as absorption filters, reflectors, mirrors, lens systems or light-wave conductors.

According to the invention irradiation can be carried out in such a way as to ensure that thorough crosslinking of the layer of clear lacquer is effected in one step. It can however also be advantageous to bring about a prior gelling of the coating film by UV-induced crosslinking, e.g. in a first zone in which black-light irradiation takes place, and then to continue crosslinking in a second step or several steps, for example by renewed UV irradiation or by irradiation with electron rays.

The arrangement of the radiation source is in principle well-known and can be adjusted to suit the conditions of the workpiece and the parameters of the process.

For example, the workpiece can be irradiated as a whole, or a radiation curtain can be used which moves in relation to the workpiece. In addition, by the use of an automatic device a spot-type radiation source can be passed over the substrate to initiate the crosslinking process. In order to achieve a crosslinking reaction on all sides of the workpiece, movement of the substrate in front of the radiation sources about the longitudinal or transverse axes is also possible.

The distance of the radiation source can be fixed or it can be adapted to a desired value according to the form of the substrate. The distances of the radiation sources from the wet-lacquer surface preferably lie in the range from 2 to 25 cm, and in particular 5–10 cm. If a UV laser is used, a greater distance is possible.

Of course, the process steps listed as examples can also be combined. This can be effected in a single stage of the process or in process stages temporally or spatially separated from one another.

The duration of irradiation lies for example in the range from 0.1 seconds to 30 minutes, according to lacquer system and radiation source. A duration of less than 5 minutes is preferred. The duration of irradiation is chosen in such a way as to achieve total curing so the formation of the required technological characteristics is ensured.

The process according to the invention can be used to particular advantage in the production of multi-layer lacquer coatings in the automobile industry, e.g. in the manufacture of car bodies or their parts.

A problem with the coating of automobile bodies with radiation-curable lacquer systems lies in the curing of areas not directly accessible to radiation such as shadow zones, e.g. cavities, folds and other undercuts resulting from manufacture. This problem can be solved by, e.g., using spot-type, small-area or omnidirectional emitters with an automatic movement device directed to irradiating interiors, engine compartments, cavities or edges.

It is also possible to apply a thermal activation in order to bring about crosslinking of the coating agent on surfaces which can not be subjected to the radiation-crosslinking process adequately. When using coating agents capable of polymerization in radicalic manner it can be advantageous in this connection to use radical initiators which can be activated thermally, so that subsequent to irradiation or simultaneously with irradiation thermally activated radicalic polymerization can be achieved. When using cationically polymerizing coating agents it is not necessary to use special initiators which can be activated thermally. The cationic polymerization initiated by the radiation energy also spreads to the shadow zones, i.e., the unirradiated or only slightly irradiated surfaces. It is however also advantageous in this case to apply heat in order to support polymerization in the shadow zones.

According to the invention radiation-curable clear-lacquer coating agents can be used which are well-known in principle and described in the literature. This involves either systems which are curable in radicalic manner, i.e. by the effect of radiation on the coating agent radicals are formed which then trigger the crosslinking reaction, or systems which are curable in cationic manner, in which by irradiation of initiators Lewis acids are formed and serve to trigger the crosslinking reaction.

Systems which are curable in radicalic manner make use of, e.g., prepolymers, such as polymers or oligomers which have olefinic double bonds in the molecule. These prepolymers can optionally be dissolved in reactive diluents, i.e. reactive liquid monomers. In addition, coating agents of this type can also contain conventional initiators, light-ray-absorbing agents and, optionally, transparent pigments, soluble dyestuffs and additional auxiliary lacquering agents.

Examples of prepolymers or oligomers are (meth)acrylic-functional (meth)acrylic copolymers, epoxide resin (meth-)acrylates which are free of aromatic structural units, polyester(meth)acrylates, polyether(meth)acrylates, polyurethane(meth)acrylates, unsaturated polyesters, amino(meth)acrylates, melamine(meth)acrylates, unsaturated polyurethanes or silicon(meth)acrylates. The molecular weight (number average Mn) lies preferably in the range from 200 to 10000, and in particular from 500 to 2000. Here and in the following, (meth)acrylate denotes acrylate and/or methacrylate, and (meth)acrylic denotes acrylic and/or methacrylic.

If reactive diluents are employed they are generally used in quantities between 1 and 50% by weight, and preferably 5–30% by weight, relative to the total weight of prepolymers and reactive diluents. They can be mono-, di- or polyunsaturated. Examples of such reactive diluents are: (meth-)acrylic acid and its esters, maleic acid and its semi-esters, vinyl acetate, vinyl ether, substituted vinyl carbamides, alkylene glycol di(meth)acrylate, polyethylene glycol di(meth)acrylate, 1,3-butanediol di(meth)acrylate, vinyl-(meth)acrylate, allyl(meth)acrylate, glycerine tri(meth)acrylate, trimethylolpropane tri(meth)acrylate, styrene, vinyl toluene, divinyl benzene, pentaerythritol tri(meth)acrylate, pentaerythritol tetra(meth)acrylate, dipropylene glycol di(meth)acrylate and hexanediol di(meth)acrylate, as well as mixtures thereof. They serve to influence viscosity and technical lacquering characteristics, such as, e.g., the crosslinking density.

Photoinitiators for systems curable in radicalic manner can, e.g., be used in amounts from 0.1 to 5% by weight, and preferably 0.5–3% by weight, relative to the total quantity of prepolymers which may be polymerized in radicalic manner, in addition to the reactive diluents and initiators. It is advantageous if their absorption range is within 260–450 nm. Examples of photoinitiators are benzoin and derivatives, benzil and derivatives, benzophenone and derivatives, acetophenone and derivatives, e.g., 2,2-diethoxyacetophenone, thioxanthone and derivatives, anthraquinone, 1-benzoylcyclohexanol, and organophosphorus compounds such as acylphosphine oxide. The photoinitiators can be used on their own or in combination. In addition, other synergistic components, e.g. tertiary amines, can be used.

In addition to the photoinitiators, conventional photosensitisers such as anthracene can also be used, if necessary, in the usual quantities, for example with a view to irradiation with black-light tubes. Additionally, radicalic initiators which can be activated thermally can optionally be used, so that between 80° and 120° C., radicals are formed which then start the crosslinking reaction. Examples of thermolabile radicalic initiators are: organic peroxides, organic azo compounds or C-C-dissociating initiators such as dialkyl peroxides, peroxocarboxylic acids, peroxodicarbonates, peroxide esters, hydroperoxides, ketone peroxides, azodinitriles or benzpinacolsilyl ethers. C-C-dissociating initiators are particularly preferred, since with thermal dissociation no gaseous reaction products are formed which can cause faults in the lacquer coating. The preferred quantities to be used are between 0.1 and 5% by weight relative to the total quantity of prepolymers which may be polymerized in radicalic manner, in addition to the reactive diluents and initiators. The initiators can also be used in a mixture.

Binding agents for cationically polymerizing coating agents are for example polyfunctional epoxy oligomers which contain more than two epoxy groups in the molecule. It is advantageous if the binding agents are free from aromatic structures. Such epoxy oligomers are, for example, described in DE-OS 36 15 790. They are, for example, polyalkylene glycol diglycidyl ethers, hydrated bisphenol-A glycidyl ethers, epoxy urethane resins, glycerine triglycidyl ethers, diglycidylhexahydrophthalate, diglycidyl esters of dimeric acids, epoxidated derivatives of (methyl)cyclohexene such as 3,4-epoxycyclohexyl-methyl-(3,4-epoxycyclohexane)carboxylate or epoxidated polybutadiene. The number average molecular weight of the polyepoxide compounds preferably lies below 10000.

If low viscosities are needed for application they can be adjusted by the use of reactive diluents, i.e. reactive liquid compounds such as cyclohexene oxide, butene oxide, butanediol diglycidyl ether or hexanediol diglycidyl ether. Examples of additional reactive solvents are alcohols, polyalkylene glycols, polyalcohols, hydroxy-functional polymers, cyclic carbonates or water. These can also contain solid constituents in solution, for example solid polyalcohols such as trimethylolpropane.

Photoinitiators for cationically curable systems are used in amounts from 0.5 to 5% by weight, on their own or in combination, relative to the total quantity of cationically polymerisable prepolymers, reactive diluents and initiators. There are substances known as onium salts which when irradiated give rise photolytically to Lewis acids. Examples are diazonium salts, sulfonium salts or iodine onium salts. Particularly preferred are triarylsulfonium salts.

Non-reactive solvents for systems which are curable in radicalic and cationic manner are conventional lacquer solvents such as esters, ethers, and ketones, for example butyl acetate, ethylene glycol ether, methylethyl ketone, and methylisobutylketone, as well as aromatic hydrocarbons. For systems which are to be polymerized in radicalic manner $C_2$–$C_4$-alkanols, and preferably water, are also suitable as solvents.

The clear lacquers used according to the invention preferably have light-ray-absorbing agents added to them. Examples of these are phenyl salicilates, benzotriazole and derivatives, and HALS compounds, as well as oxalanilide derivatives, optionally also used in combination. Customary concentrations amount to 0.5 to 5% by weight, preferably 1–2% by weight, relative to the total quantity of clear lacquer. When choosing the light-ray-absorbing agent, attention must be given to ensuring that the initiation of crosslinking is not impaired by the light-ray-absorbing agent and that such agents that are used are stable when irradiated during the radiation-curing process.

Further additives may include, for example, elastifying agents, polymerisation inhibitors, defoamers, levelling agents, anti-oxidation agents, transparent dyestuffs or optical brightening agents.

Transparent colourless fillers and/or pigments can optionally be added to the coating agent. The amount used is up to 10% by weight, relative to the total amount of clear lacquer. Examples are silicon dioxide, mica, magnesium oxide, titanium dioxide or barium sulphate. The size of the particles preferably lies below 200 nm. With UV-curable systems attention should be given to ensuring that the coating film in the layer thickness used remains transparent to UV radiation. Additional useable additives are, for example, conventional inorganic or organic delustering agents. These can be added in conventional amounts, for example up to 10% by weight. Examples of delustering agents are silicates, pyrogenic silicic acids such as aerosil, bentone or condensed and crosslinked urea formaldehyde resins, and natural and synthetic waxes. The particle sizes of such delustering agents lie generally in a range up to 100 μm, and preferably up to 30 μm.

The stages of the process for producing suitable radiation-curable clear-lacquer coating agents are well-known. It is possible to combine systems with different radiation-induced chemical crosslinking mechanisms. These can be various crosslinking systems curable in radicalic manner, or cationically curable crosslinking systems, or radically and cationically curable crosslinking combined with one another. Attention should be given to choosing the composition in such a way as to ensure long storage life. Likewise different reaction-initiating processes can be combined, for example UV with UV curing, UV with thermal initiation or electron-ray curing with UV curing.

The various crosslinking reactions can be started with mixtures of suitable initiators. For example, mixtures of UV initiators with differing maximum absorption characteristics are possible. In this way various emission maxima of one or several radiation sources can be utilized. This can be effected simultaneously or in sequence. For example, curing can be initiated with radiation from one radiation source and continued with that from another. The reaction can then be carried out in two or more stages, and separated spatially if desired. The radiation sources used can be the same or different.

According to the invention it is possible to carry out firstly a radiation-induced, and either sequentially or simultaneously, a thermally induced crosslinking reaction. To this end, and in addition to one or several photoinitiators, one or several thermally dissociating initiators can optionally be used. The use of photoinitiators is not necessary when curing by electron rays.

Two- or multi-stage operation can be advantageous, in order, for example, to achieve initial gelling, whereby for example runs on lacquered vertical surfaces can be avoided. Gelling is also advantageous in the case of solvent-based systems to allow evaporation of the solvent.

The photoinitiators are preferably chosen in such a way that they do not decay in light having a wavelength of over 550 nm. With the use of thermally dissociating initiators these should be chosen in such a way as to ensure that they do not decay under the conditions of application of the lacquer material. In this way it is possible to recycle the overspray of the coating agent directly and to re-use it, since a chemical reaction is avoided during application.

The crosslinking density of the lacquer films can be adjusted by the functionality of the components of the binding agent employed. The choice can be made in such a way as to ensure that the crosslinked clear-lacquer coating has sufficient hardness and that too high a degree of crosslinking is avoided, in order to prevent the film from becoming too brittle.

By means of the process according to the invention multi-layer coatings are obtained which constitute a clear-lacquer surface with high resistance to scratching and also a high degree of gloss, as well as a high degree of mechanical durability. As a result of the process parameters and the chosen crosslinking mechanism, the overspray of the coating agent to be applied likewise can be made available for immediate re-use. The process according to the invention is particularly suitable for use in series production lacquering in the automobile industry; for example, for the lacquering of car bodies and their parts.

In all the examples described below, application of the radiation-curable clear lacquers was performed in a room illuminated exclusively by red-light sources (light wavelength greater than 600 nm).

EXAMPLE 1

By mixing the following components a radiation-curable clear-lacquer coating agent was formed:

| % by weight | |
|---|---|
| 44.5 Novacure 3200 | (aliphatic epoxy acrylate made by Interorgane) |
| 32.2 Ebecryl 264 | (aliphatic urethane acrylate made by UCB) |
| 3.0 Irgacure 184 | (photoinitiator made by CIBA) |
| 10.0 dipropylene glycol | diacrylate |
| 10.0 trimethylolpropane | triacrylate |

-continued

| % by weight | |
|---|---|
| 0.3 Ebecryl 350 | (silicon acrylate made by UCB) |

Subsequently a lacquer structure was produced as follows:

A metal plate with a primer composed of KTL (20 μm) and pre-coated with filler which is customary in the trade (35 μm) was coated in one case with conventional water-based lacquer, in a second case with solvent-containing basecoat (15 μm dry layer thickness), and then in both cases stoved for 20 min at 140° C. Subsequently the above lacquer system was applied with a layer thickness of 35 μm.

Given a belt velocity of 9 m/min, curing of the horizontal metal test plate was effected by irradiation by two medium-pressure mercury emitters, each of which having an output of 100 W/cm and placed at a distance of 10 cm from the surface to be cured (duration of irradiation 1–2 sec). A shiny and hard surface with good adhesion was obtained on both the aqueous basecoat and the conventional basecoat.

EXAMPLE 2

| % by weight |
|---|
| 40.5 Novacure 3200 |
| 27.5 Ebecryl 264 |
| 2.0 C—C-dissociating initiator (tetraphenylethane derivative according to DE-A-1 219 224) |
| 2.0 Irgacure 184 |
| 10.0 dipropylene glycol diacrylate |
| 10.0 tripropylene glycol diacrylate |
| 0.3 Ebecryl 350 |
| 7.7 vinyl toluene |

A metal test plate was produced in a similar way to that described in Example 1. In this case, however, the test plate was coated on both sides, and after application of the above radiation-curable clear lacquer it was irradiated on just one side while freely suspended, the side to be irradiated being moved evenly, at a distance of 10 cm within 5 sec, past a medium-pressure mercury emitter as stated in Example 1.

The tacky rear side which was only partially crosslinked by irradiation was stoved for 15 min at 110° C. in an air-circulating furnace.

Surfaces were obtained on both sides of the metal test plate with characteristics as described in Example 1.

EXAMPLE 3

(radiation-induced cationically curable clear lacquer)

| % by weight | |
|---|---|
| 60.0 Degacure K 126 | (cycloaliphatic epoxide made by DEGUSSA) |
| 25.0 Araldit DY 026 | (hexanediol diglycidyl ether made by CIBA) |
| 4.5 Degacure KI 85 | (sulfonium salt made by DEGUSSA) |
| 0.5 Dynasilan Glymo | (glycidyl-functional silane made by Dynamit Nobel) |
| 10.0 cyclohexanol | |

With this formulation the procedure was completely analogous to that in Example 1. A similar lacquered surface was obtained.

EXAMPLE 4

Example 1 was repeated, with the same lacquer result. The only difference being that the basecoat layers here were stoved for 30 min at 120° C. and pre-coated polycarbonate sheets were used.

EXAMPLE 5

To 100 parts of the clear-lacquer coating agent from Example 1, two parts of anthracene were added as photosensitiser. Application was effected as described in Example 1. Then irradiation was effected at a belt velocity of 1 m/min, lying flat, with 10 black-light tubes at a distance of 10 cm from the wet-lacquer surface (duration of irradiation 90–120 sec). A tacky, partially crosslinked surface was obtained. The metal test plate was suspended for 5 min and then, hanging free, irradiated, the still tacky surface being moved uniformly, at a distance of 10 cm within 5 sec, past a medium-pressure mercury emitter as stated in Example 1. A lacquer result as stated in Example 1 was obtained. The surface was free from runs.

We claim:

1. Process for producing a multi-layer lacquer coating on a surface provided with a dry basecoat, the process comprising the steps of:

eliminating substantially all light around the surface having a wavelength below 550 nm;

selecting a polyermizing coating agent from a group consisting of radicalic-curable lacquer and cationic-curable lacquer;

applying a layer of the coating agent on the basecoat, the coating agent layer being applied on the basecoat after substantially all light around the surface having a wavelength below 550 nm has been eliminated; and exposing the coating agent layer to high-energy radiation to polymerize the coating agent and cure the coating agent layer on the basecoat.

2. Process according to claim 1, wherein the exposing step is performed using UV radiation in the wavelength range from 180 to 420 nm.

3. Process according to claim 1, wherein the exposing step is performed by irradiation with electron rays.

4. Process according to claim 1, wherein the exposing step is performed using a plurality of sources of radiation in succession in two or more stages.

5. Process according to claim 1, wherein after the step of exposing the coating agent layer to high-energy radiation is initiated additional curing is effected by thermal means or is continued by thermal means.

6. Process according to claim 5, wherein the coating agent selected by the selecting step is curable by radicalic polymerization and contains one or more photoinitiators and one or more radical initiators capable of being activated thermally.

7. Process according to claim 5, wherein the coating agent selected by the selecting step is curable by cationic polymerization and contains one or more photoinitiators.

8. Process according to claim 1, wherein the coating agent selected by the selecting step contains at least one component from a group including transparent pigments and soluble dyestuffs.

9. Process according to claim 1, wherein the coating agent is further selected from a group including lacquers essentially free from solvents and lacquers containing water as solvent.

10. Process according to claim 1, wherein the coating agent is applied on the basecoat with a dry layer thickness of 10–80 μm.

11. Process according to claim 1, wherein the applying step includes spraying the coating agent onto the basecoat and collecting any overspray accruing for recycled spray application of the coating agent after replacement of any necessary components.

12. Process according to claim 1, wherein the applying step includes collecting any excess coating agent not forming the coating agent layer for recycled application.

13. Process according to claim 1, wherein the multi-layer lacquer is produced on the surface of an automobile part.

14. Process according to claim 1, wherein the eliminating step is performed by excluding substantially all light around the surface.

* * * * *

UNITED STATES PATENT AND TRADEMARK OFFICE

CERTIFICATE OF CORRECTION

PATENT NO. : 5,486,384

DATED : January 23, 1996

INVENTOR(S) : Udo BASTIAN, Manfred STEIN

It is certified that error appears in the above-indentified patent and that said Letters Patent is hereby corrected as shown below:

Column 2, line 8, change "accruing" to --occurring--;

Column 10, line 34, change "polyermizing" to --polymerizing--; and

Column 11, line 10, change "accruing" to --occurring--.

Signed and Sealed this

Fourteenth Day of July, 1998

Bruce Lehman

*Attest:*

BRUCE LEHMAN

*Attesting Officer*

*Commissioner of Patents and Trademarks*